US008901835B2

(12) United States Patent
Kang et al.

(10) Patent No.: US 8,901,835 B2
(45) Date of Patent: Dec. 2, 2014

(54) LED LIGHTING SYSTEMS, LED CONTROLLERS AND LED CONTROL METHODS FOR A STRING OF LEDS

(75) Inventors: Chin-Feng Kang, Hsin-Chu (TW); Jing-Chyi Wang, Hsin-Chu (TW)

(73) Assignee: Analog Integrations Corporation, Science Park, Hsin-Chu (TW)

( * ) Notice: Subject to any disclaimer, the term of this patent is extended or adjusted under 35 U.S.C. 154(b) by 341 days.

(21) Appl. No.: 13/466,133

(22) Filed: May 8, 2012

(65) Prior Publication Data

US 2012/0217887 A1 Aug. 30, 2012

Related U.S. Application Data

(63) Continuation-in-part of application No. 12/942,030, filed on Nov. 9, 2010, now Pat. No. 8,664,930.

(30) Foreign Application Priority Data

Sep. 15, 2010 (TW) ..... 99131210 A

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 41/14*** | (2006.01) |
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0809* (2013.01); *H05B 33/083* (2013.01); *H05B 33/0848* (2013.01)

USPC ..... 315/193; 315/201; 315/297

(58) Field of Classification Search

None

See application file for complete search history.

(56) References Cited

U.S. PATENT DOCUMENTS

| | | | | |
|---|---|---|---|---|
| 8,384,311 | B2 | 2/2013 | Gray | |
| 8,664,930 | B2 | 3/2014 | Kang | |
| 2010/0194298 | A1 | 8/2010 | Kuwabara | |
| 2011/0089844 | A1 * | 4/2011 | Grajcar | 315/193 |
| 2011/0273103 | A1 | 11/2011 | Hong | |
| 2012/0098463 | A1 | 4/2012 | Stamm | |

FOREIGN PATENT DOCUMENTS

| | | | |
|---|---|---|---|
| CN | 201248164 | Y | 5/2009 |
| JP | 2006351473 | A | 12/2006 |

(Continued)

OTHER PUBLICATIONS

Zhang Long-Guo, "Integration Design of Input Current Shaping-Based Single-Stage AC/DC Converters and the Application on Electronic Ballast for Gas Discharge Lamps", National Science Council research roport, Nov. 4, 2005, Abstract.

*Primary Examiner* — Douglas W Owens
*Assistant Examiner* — Dedei K Hammond
(74) *Attorney, Agent, or Firm* — Winston Hsu; Scott Margo

(57) ABSTRACT

LED controllers, LED lighting systems and control methods capable of providing an average luminance intensity independent from the variation of an AC voltage. LEDs are divided into LED groups electrically connected in series between a power source and a ground. A disclosed LED controller has path switches, a management center and a line waveform sensor. Each path switch is for coupling a corresponding LED group to the ground. The management center controls the path switches. When turning off an upstream path switch, the management center controls a downstream path switch for a downstream LED group to make the driving current passing the upstream LED group substantially approach a target value. The line waveform sensor is coupled to the power source, sensing the waveform of the input voltage of the power source. The line waveform sensor is configured to decrease the target value when the input voltage increases.

15 Claims, 8 Drawing Sheets

(56) References Cited

FOREIGN PATENT DOCUMENTS

| | | |
|---|---|---|
| JP | 200860604 A | 3/2008 |
| JP | 2011238605 | 11/2011 |
| TW | 201037213 | 10/2010 |
| TW | 201117665 | 5/2011 |
| TW | 201211722 | 3/2012 |

* cited by examiner

LED LIGHTING SYSTEMS, LED CONTROLLERS AND LED CONTROL METHODS FOR A STRING OF LEDS

CROSS-REFERENCE TO RELATED APPLICATIONS

This application is a continuation-in-part of U.S. patent application Ser. No. 12/942,030, filed on Nov. 9, 2010, which is hereby incorporated by reference in its entirety.

BACKGROUND

The present disclosure relates generally to LED lighting systems and LED control methods therefor.

There are different kinds of lighting devices developed in addition to the familiar incandescent light bulb, such as halogen lights, florescent lights and LED (light emitting diode) lights. LED lights have several advantages. For example, LEDs have been developed to have lifespan up to 50,000 hours, about 50 times as long as a 60-watt incandescent bulb. This long lifespan makes LED light bulbs suitable in places where changing bulbs is difficult or expensive (e.g., hard-to-reach places, such as the exterior of buildings). Furthermore, an LED requires minute amount of electricity, having luminous efficacy about 10 times higher than an incandescent bulb and 2 times higher than a florescent light. As power consumption and conversion efficiency are big concerns in the art, LED lights are expected to replace several kinds of lighting fixtures in the long run.

A LED is a current-driven device. As commonly known in the art, the brightness of a LED is substantially dominated by its driving current, and the voltage drop across the LED illuminating is about a constant. Accordingly, a driver for driving LEDs is commonly designed to function as a constant current source or a controllable current source. FIG. 1 shows LED lighting system 10 according to U.S. Pat. No. 6,989,807 in the art. LED string 14, comprising LEDs $\mathbf{15}_a$, $\mathbf{15}_b$, and $\mathbf{15}_c$, connected in series, is coupled to a power source provided by bridge rectifier 12, which is connected to a branch circuit providing AC voltage $V_{AC}$. LED controller 16 detects input voltage $V_{IN}$ output from bridge rectifier 12 and accordingly controls current sources $\mathbf{18}_a$, $\mathbf{18}_b$ and $\mathbf{18}_c$. As taught in U.S. Pat. No. 6,989,807, input voltage $V_{IN}$ is sensed for determining how many LEDs in LED string 14 are excluded from being driven. In some instants, for example, the most downstream LED $\mathbf{15}_c$ is not driven because current source $\mathbf{18}_c$ is turned off. FIGS. 2A and 2B demonstrate two different luminance intensity results from LED lighting system 10 driven by branch circuits of 200 ACV and 100 ACV, respectively. In FIGS. 2A and 2B, threshold voltages $V_{TH1}$, $V_{TH2}$ and $V_{TH3}$ are the minimum voltages required for turning on the LED string with only LED $\mathbf{15}_a$, the LED string with LEDs $\mathbf{15}_a$ and $\mathbf{15}_b$, and the LED string with LEDs $\mathbf{15}_a$, $\mathbf{15}_b$ and $\mathbf{15}_c$, respectively. As $V_{IN}$ gradually increases over threshold voltages $V_{TH1}$, $V_{TH2}$ and $V_{TH3}$, LEDs $\mathbf{15}_a$, $\mathbf{15}_b$, and $\mathbf{15}_c$ are sequentially turned on, and vice versa. Each LED in FIG. 1 is intended to be driven by a fix current when it shines. Thus, the present number of the LEDs joining to shine decides the instant luminance intensity of LED lighting system 10. The top boundaries of the shadowed areas in FIGS. 2A and 2B represent luminance intensity of LED lighting system 10.

Nevertheless, LED lighting system 10 shines brighter in FIG. 2A than it does in FIG. 2B, because the shadowed area in FIG. 2A, roughly corresponding to the average luminance intensity of LED lighting system 10, is larger than that in FIG. 2B. Taking LED $\mathbf{15}_a$ for example, it is turned on earlier but turned off later in FIG. 2A than it is in FIG. 2B. So are LEDs $\mathbf{15}_b$ and $\mathbf{15}_c$. The higher input voltage $V_{IN}$, the longer turn-on time of each LED in LED string 14, and the brighter LED lighting system 10. A LED lighting system with a constant average luminance intensity that does not vary along with the AC voltage of a branch circuit is much more preferred, nevertheless.

SUMMARY

Embodiments of the present invention disclose a LED controller, suitable for controlling a string of LEDs. The LEDs are divided into LED groups electrically connected in series between a power source and a ground. The LED controller has path switches, a management center and a line waveform sensor. Each path switch is for coupling a corresponding LED group to the ground. The management center controls the path switches. When turning off an upstream path switch, the management center controls a downstream path switch for a downstream LED group to make the driving current passing the upstream LED group substantially approach a target value. The line waveform sensor is coupled to the power source, for sensing the waveform of the input voltage of the power source. The line waveform sensor is configured to decrease the target value when the input voltage increases.

Embodiments of the present invention disclose a LED lighting system. The LED lighting system comprises a string of LEDs and a LED controller. The LEDs are divided into LED groups electrically connected in series between a power source and a ground. The LED controller comprises path switches, a management center, a line waveform sensor, and a line voltage sense pin. Each path switch is for coupling a corresponding LED group to the ground. The management center controls the path switches. A downstream path switch for a downstream LED group is controlled to make the driving current passing an upstream LED group substantially approach a target value. The line waveform sensor is coupled to the power source, for sensing the line waveform sensor of the input voltage of the power source. The line waveform sensor is configured to decrease the target value when the input voltage increases. The line voltage sense pin coupled to the line waveform sensor and the power source.

Embodiments of the present invention disclose a LED control method suitable for controlling a string of LEDs. The LEDs are divided into LED groups electrically connected in series between a power source and a ground. Path switches are provided, and are capable of separately coupling the LED groups to the ground. The current passing through an upstream path switch is gradually decreased when the current through a downstream path switch gradually increases, so that the driving current passing an upstream LED group substantially approaches a target value. The waveform of the input voltage of the power source is sensed and when the input voltage increases the target value is decreased.

BRIEF DESCRIPTION OF THE DRAWINGS

The invention can be more fully understood by the subsequent detailed description and examples with references made to the accompanying drawings, wherein.

DETAILED DESCRIPTION

The following embodiments are described in sufficient detail to enable those skilled in the art to make and use the invention. It is to be understood that other embodiments would be evident based on the present disclosure, and that improves or mechanical changes may be made without departing from the scope of the present invention.

In the following description, numerous specific details are given to provide a thorough understanding of the invention. However, it will be apparent that the invention may be practiced without these specific details. In order to avoid obscuring the present invention, some well-known configurations and process steps are not disclosed in detail.

Figure 1:
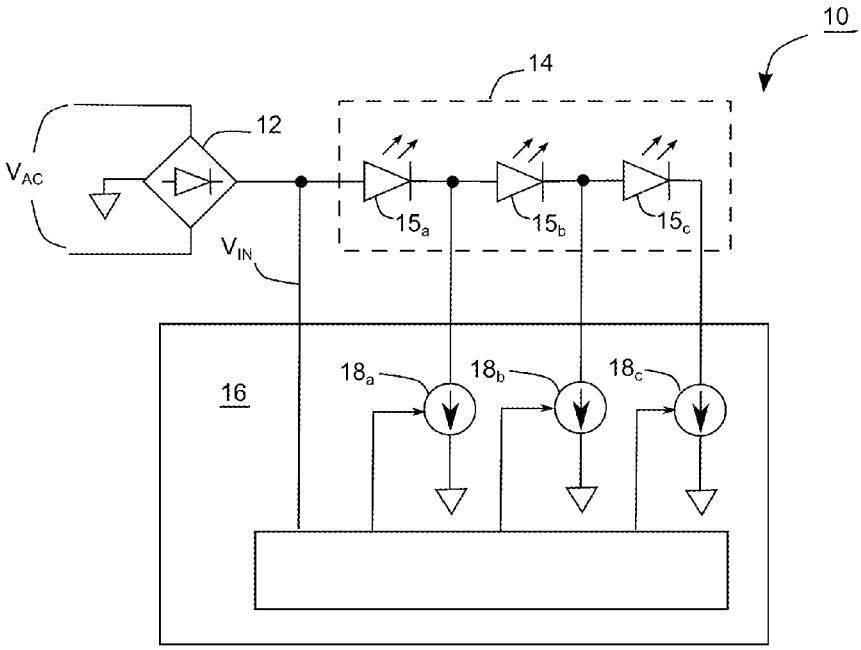
FIG. 1 PRIOR ART
FIG. 1 shows a LED lighting system in the art.
Figure 3:
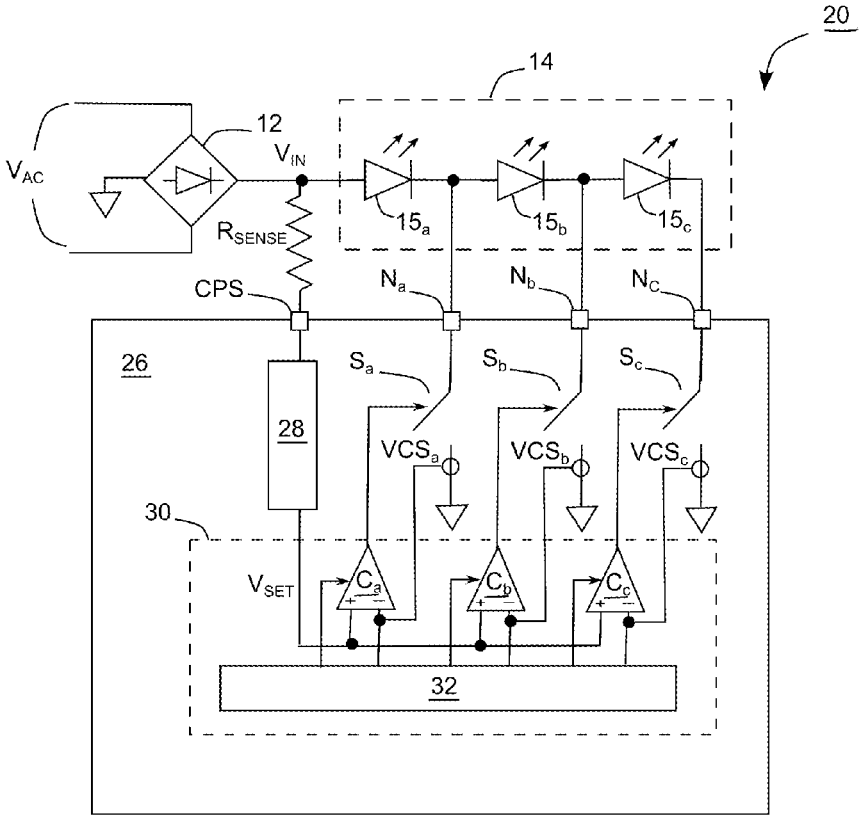
FIG. 3 shows a LED lighting system according to embodiments of the invention.

FIG. 3 shows a LED lighting system according to embodiments of the invention. Similar with LED lighting system 10 in FIG. 1, LED lighting system 20 in FIG. 3 has LED string 14 with LEDs $\mathbf{15}_a$, $\mathbf{15}_b$ and $\mathbf{15}_c$ connected in series. Each LED in LED string 14 represents a LED group, which in one embodiment includes only one micro LED, and in some other embodiments includes several micro LEDs connected in series or in parallel. The LED string according to the invention is not limited to have only 3 LEDs, and could have any number of LEDs in other embodiments. Bridge rectifier 12, connected to a branch circuit providing an AC voltage $V_{AC}$, generates input voltage $V_{IN}$ as an input power source to power LED string 14.

LED controller 26 could be embodied in an integration circuit with several pins. One pin of LED controller 26, referred to as pin CPS (an abbreviation of CONSTANT-POWER SENSE), is coupled by resistor $R_{SENSE}$ to sense the waveform of input voltage $V_{IN}$. Pins $N_a$, $N_b$, $N_c$ are respectively connected to the cathodes of LEDs $\mathbf{24}_a$, $\mathbf{24}_b$ and $\mathbf{24}_c$, providing separate conduction paths to drain current to ground. Inside LED controller 26 are path switches $S_a$, $S_b$, and $S_c$, line waveform sensor 28 and management center 30.

Path switches $S_a$, $S_b$, and $S_c$ respectively control conduction paths from pins $N_a$, $N_b$, $N_c$, to the ground, and are controlled by management center 30. The control circuit for one path switch is similar with the one for another. Taking the control for path switch $S_a$ as an example, switch controller $C_a$, which is an operational amplifier in this embodiment, could operate in one of several modes, including but not limited to fully-ON, fully-OFF, and constant-current modes, depending upon the signal sent from mode decider 32. For example, when switch controller $C_a$ is determined to operate in the constant-current mode, switch controller $C_a$ controls the impedance of path switch $S_a$ to make current sense voltage $VCS_a$ approach current-setting voltage $V_{SET}$. Current sense voltage $VCS_a$ is the detection result representing the current passing path switch $S_a$. When switch controller $C_a$ is determined to operate in the fully-ON mode, path switch $S_a$ is always ON, performing a short circuit, disregarding current sense voltage $VCS_a$. On the other hand, when switch controller $C_a$ is determined to operate in the fully-OFF mode, path switch $S_a$ is always OFF, performing an open circuit, disregarding current sense voltage $VCS_a$. In one instant when input voltage $V_{IN}$ is high enough to turn on the LED string with only LEDs $\mathbf{15}_a$ and $\mathbf{15}_b$, for example, switch controllers $C_a$, $C_b$ and $C_c$ could operate in the fully-OFF, constant-current and fully-ON modes, respectively, such that the current passing through LEDs $\mathbf{15}_a$ and $\mathbf{15}_b$ are the same, corresponding to current-setting voltage $V_{SET}$, and that current passing through LED $\mathbf{15}_c$ is about zero. If later on input voltage $V_{IN}$ ramps down and mode decider 32 finds current sense voltage $VCS_b$ cannot increase to approach current-setting voltage $V_{SET}$, then mode decider 32 changes the operation modes of switch controllers $C_a$ and $C_b$ to be constant-current and fully-ON modes, respectively. Therefore, the current passing through LED $\mathbf{15}_a$ stays at the same value corresponding to current-setting voltage $V_{SET}$, and those passing through LEDs $\mathbf{15}_b$ and $\mathbf{15}_c$ are zero. In the opposite, if later on input voltage $V_{IN}$ ramps up and current sense voltage $VCS_c$ indicates that the current passing through LED $\mathbf{15}_c$ is not zero any more, switch controllers $C_b$ and $C_c$ are switched to operate in the fully-OFF and constant-current modes, respectively. From the teaching above, it can be concluded that current-setting voltage $V_{SET}$ substantially determines the target value of the current passing a LED in the LED string when that LED shines.

Figure 2A:
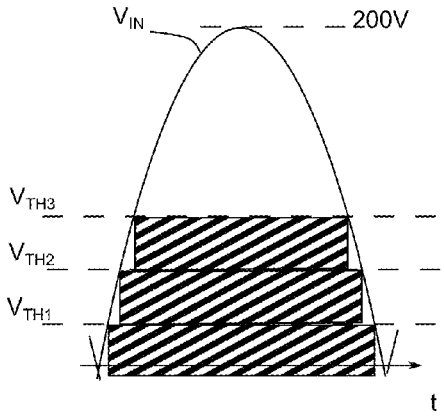
FIG. 2A PRIOR ART
FIGS. 2A and 2B demonstrate two different luminance intensity results from a LED lighting system driven by branch circuits of 200 ACV and 100 ACV, respectively.
Figure 2B:
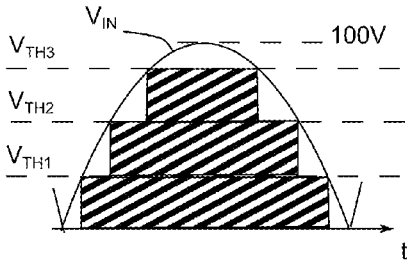
FIG. 2B PRIOR ART
Figure 4A:
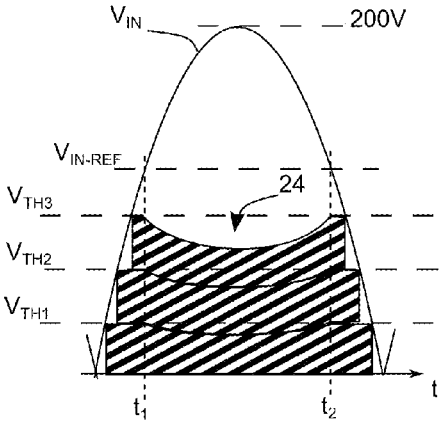
FIGS. 4A and 4B demonstrate two different luminance intensity results when the LED lighting system in FIG. 3 is powered by branch circuits of 200 ACV and 100 ACV, respectively.
Figure 4B:
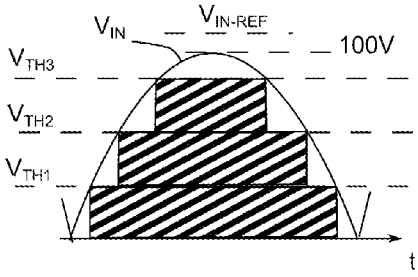

Line waveform sensor 28 detects the waveform of input voltage $V_{IN}$ via resistor $R_{SENSE}$, and accordingly provides current-setting voltage $V_{SET}$. In one embodiment, when input voltage $V_{IN}$ is under reference voltage $V_{IN\text{-}REF}$, current-setting voltage $V_{SET}$ is about a constant; and when it exceeds reference voltage $V_{IN\text{-}REF}$, the higher input voltage $V_{IN}$ the lower current-setting voltage $V_{SET}$. FIGS. 4A and 4B demonstrate two different luminance intensity results when LED lighting system 20 is powered by branch circuits of 200 ACV and 100 ACV, respectively. Threshold voltages $V_{TH1}$, $V_{TH2}$ and $V_{TH3}$ in FIGS. 4A and 4B have the similar definitions corresponding to those in FIGS. 2A and 2B. Before time point $t_1$ when input voltage $V_{IN}$ in FIG. 4A is under reference voltage $V_{IN\text{-}REF}$, luminance intensity of LED lighting system 20 increases stepwise because of the participation of a further downstream LED. In the time period between time points $t_1$ and $t_2$, the more the input voltage $V_{IN}$ exceeding reference voltage $V_{IN\text{-}REF}$, the less the current-setting voltage $V_{SET}$, the less the target current passing LEDs $\mathbf{15}_a$, $\mathbf{15}_b$ and $\mathbf{15}_c$, and the less the instant luminance intensity of LED lighting system 20. Accordingly, the top boundary of the shadowed area in FIG. 4A forms recess 24 because input voltage $V_{IN}$ has a convex above reference voltage $V_{IN\text{-}REF}$. As the waveform of input voltage $V_{IN}$ in FIG. 4B never exceeds reference voltage $V_{IN\text{-}REF}$, current-setting voltage $V_{SET}$ does not vary, and FIG. 4B is substantially the same with FIG. 2B. Unlike the area difference in quantity between FIGS. 2A and 2B which causes a different average luminance intensity under a different line voltage, recess 24 in FIG. 4A could make the amounts of the shadowed areas in FIGS. 4A and 4B substantially the same. It is achievable as a result that LED string 14 consumes substantially constant electric power when driven by different AC voltages $V_{AC}$. In other words, LED lighting system 20 could shine with substantially the same average luminance intensity, independent from the variation of the AC voltage.

Figure 5A:
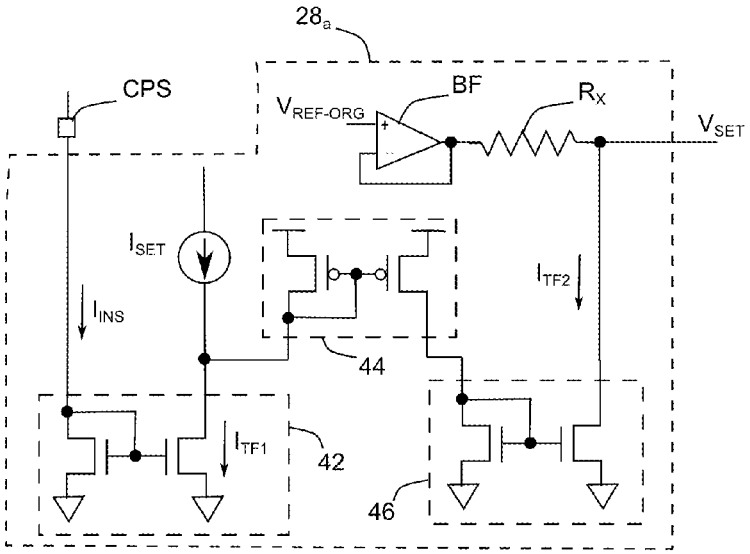
FIGS. 5A and 5B exemplify two line waveform sensors according to embodiments of the invention.
Figure 5B:
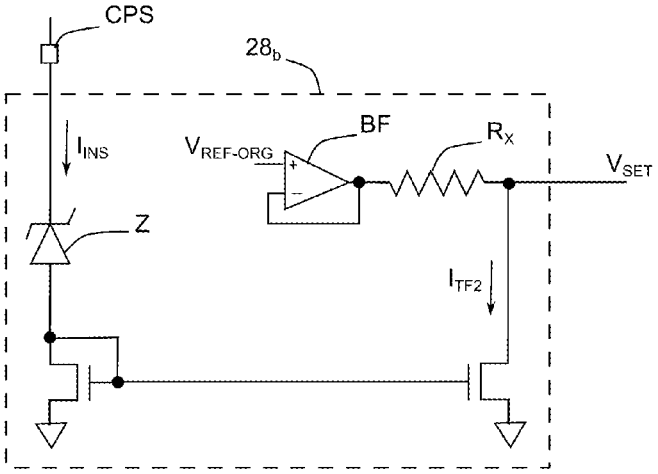

FIGS. 5A and 5B exemplify two line waveform sensors $\mathbf{28}_a$ and $\mathbf{28}_b$ according to embodiments of the invention, each capable of being employed in FIG. 3. In FIG. 5A, current mirror 42 roughly limits the highest voltage at pin CPS, and converts sense current $I_{INS}$ flowing through resistor $R_{SENSE}$ into pin CPS to provide mirror current $I_{TF1}$. Only if mirror current $I_{TF1}$ exceeds constant current $I_{SET}$ then current mirrors 44 and 46 collaborate to provide mirror current $I_{TF2}$, which drains current from output buffer BF. Mirror current $I_{TF2}$ also flows through resistor $R_X$ and is determined by sense current $I_{INS}$. If input voltage $V_{IN}$ is so small that $I_{TF1}$ does not exceed $I_{SET}$, current-setting voltage $V_{SET}$ is always equal to $V_{REF-ORG}$ outputted by output buffer BF; and if input voltage $V_{IN}$ exceeds reference voltage $V_{IN-REF}$ such that mirror current $I_{TF1}$ exceeds constant current $I_{SET}$, current-setting voltage $V_{SET}$ is decreased. In FIG. 5A, reference voltage $V_{IN-REF}$ that triggers the decreasing in current-setting voltage $V_{SET}$ could be set by, for example, $R_{SENSE}$, the current ratio provided by current mirror 42, and constant current $I_{SET}$. The amount of recession in FIG. 5A could be determined by selecting, for example, $R_{SENSE}$, the current ratio collaboratively provided by current mirrors 44 and 46, and resistor $R_X$ connected between output buffer BF and current mirror 46. FIG. 5B employs a zener diode Z to substantially determine reference voltage $V_{IN-REF}$, instead. The function and operation of FIG. 5B can be derived by persons skilled in the art based on the teaching of FIG. 5A, such that FIG. 5B is not detailed hereinafter.

Figure 6:
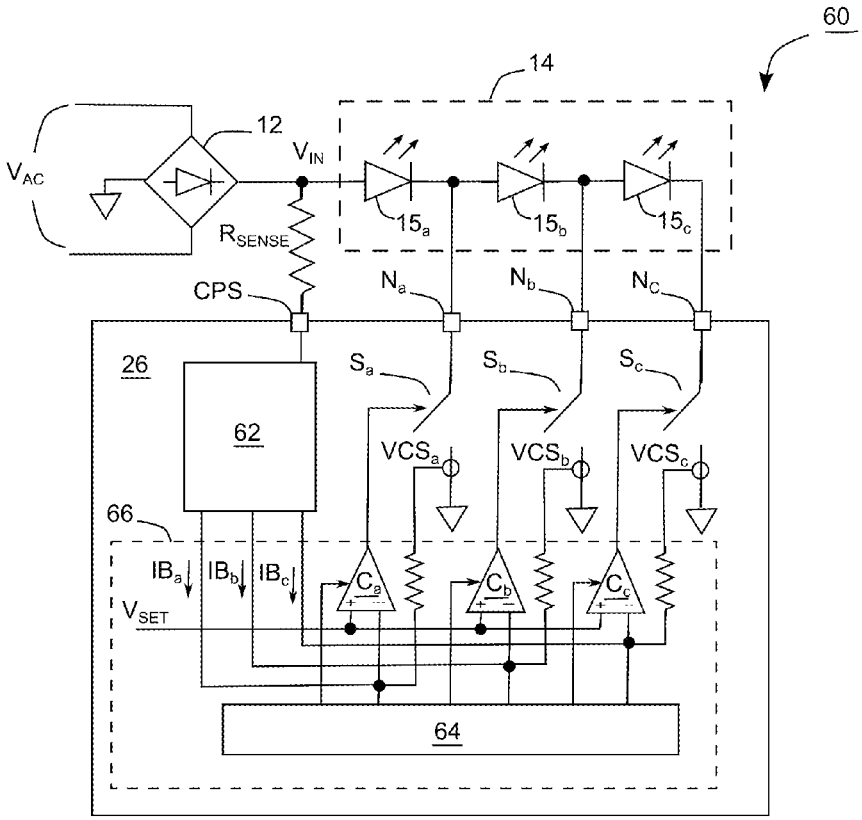
FIG. 6 shows another LED lighting system according to embodiments of the invention.
Figure 7A:
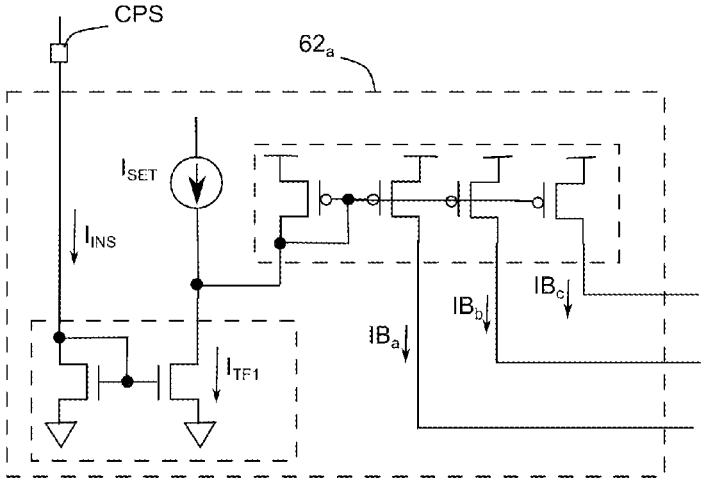
FIGS. 7A and 7B exemplify two line waveform sensors according to embodiments of the invention.
Figure 7B:
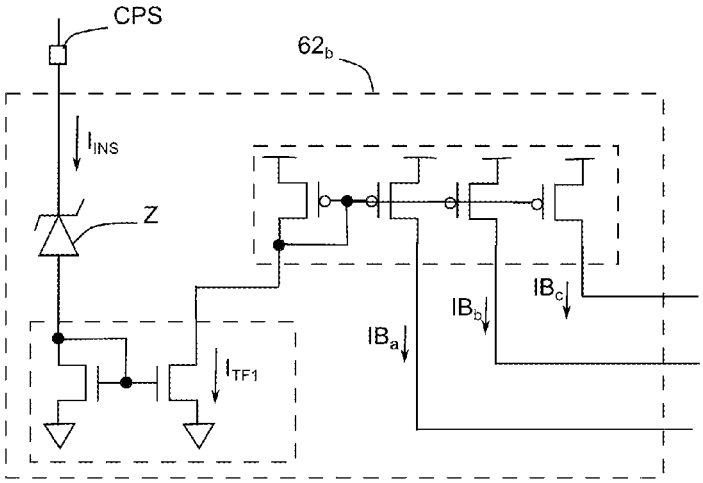

In the embodiments shown in FIGS. 3, 4A and 4B, current-setting voltage $V_{SET}$ is adjusted according input voltage $V_{IN}$, such that the target value of the current passing LEDs $\mathbf{15}_a$, $\mathbf{15}_b$ and $\mathbf{15}_c$ might change. The invention is not limited to, however. FIG. 6 shows another LED lighting system according to embodiments of the invention. LED lighting system 60 of FIG. 6 is similar with LED lighting system 20 in FIG. 3, but line waveform sensor 62 in FIG. 6 detects input voltage $V_{IN}$ to generate boost currents $IB_a$, $IB_b$ and $IB_c$, each boosting a corresponding current sense voltage, such that the target value of the current passing through a path switch is adjusted. Taking the control of path switch $S_b$ for example, boost current $IB_b$ is zero when input voltage $V_{IN}$ is less than reference voltage $V_{IN-REF}$, and switch controller $C_b$, if operating in the constant-current mode, will make the current through path switch $S_b$ approach the target value defined by current-setting voltage $V_{SET}$. In case that input voltage $V_{IN}$ exceeds reference voltage $V_{IN-REF}$, the boost current $IB_b$ starts to be provided and the target value of the current passing through path switch $S_b$ decreases. FIGS. 7A and 7B exemplify two line waveform sensors $\mathbf{62}_a$ and $\mathbf{62}_b$ according to embodiments of the invention, each capable of being employed in FIG. 6. FIGS. 7A and 7B are not detailed because they are self-explanatory based on the teaching of FIGS. 5A and 5B.

Figure 8:
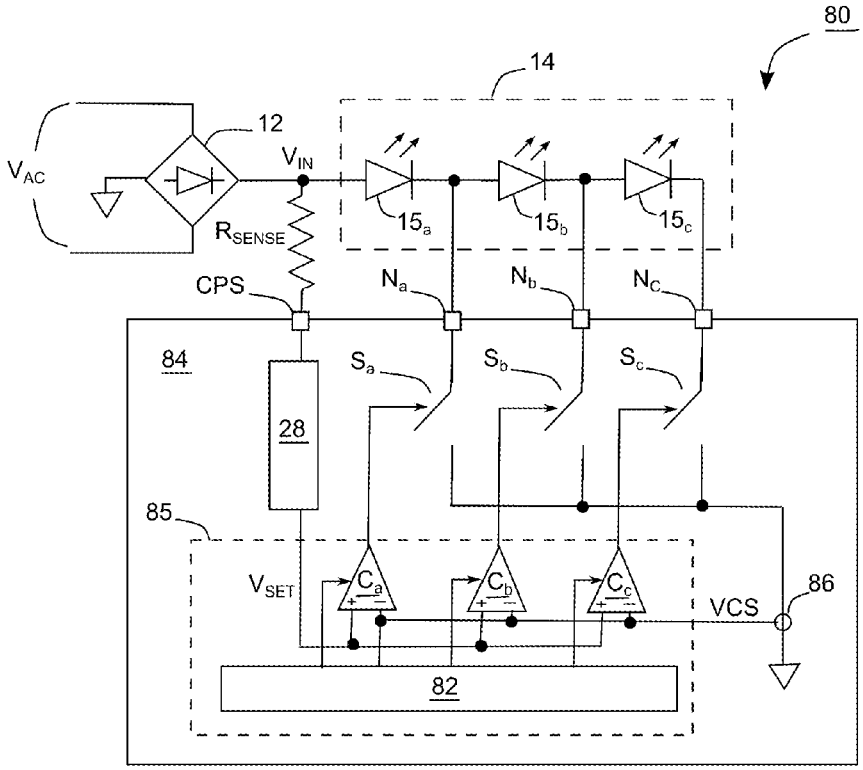
FIGS. 8, 9 and 10 show LED lighting systems according to embodiments of the invention.

FIG. 8 shows another LED lighting system 80 according to embodiments of the invention. Unlike LED controller 26 in FIG. 3, in which each path switch is provided with a separate current sensor, LED controller 84 employs only one current sensor 86 to sense the summation of the currents passing all path switches. Mode decider 82 determines the operation modes of all switch controllers $C_a$, $C_b$ and $C_c$. In the embodiment of FIG. 8, LED $\mathbf{15}_b$ is an upstream LED in respect to LED $\mathbf{15}_c$, and a downstream LED in respect to LED $\mathbf{15}_a$. A path switch coupled to the cathode of an upstream LED and a switch controller controlling that path switch are referred to as an upstream path switch and an upstream switch controller, respectively. In one embodiment, when a switch controller operates in the constant-current mode, all upstream switch controllers must operate in the fully-OFF mode and all downstream switch controllers in the fully-ON mode. In one instant when input voltage $V_{IN}$ is high enough only to turn on the LED string with only LEDs $\mathbf{15}_a$ and $\mathbf{15}_b$, for example, switch controllers $C_a$, $C_b$ and $C_c$ in FIG. 8 operate in the fully-OFF, constant-current and fully-ON modes, respectively, such that the currents passing through LEDs $\mathbf{15}_a$ and $\mathbf{15}_b$ are about the target value corresponding to current-setting voltage $V_{SET}$, and that the current passing through LED $\mathbf{15}_c$ is about zero. In case that the current flowing through path switch $S_C$ is gradually increased, the current flowing through path switch $S_b$ is gradually decreased by switch controllers $C_b$ to keep current sense voltage VCS about current setting voltage $V_{SET}$. If later on input voltage $V_{IN}$ ramps down and mode decider 82 finds current sense voltage VCS cannot increase to approach current-setting voltage $V_{SET}$, then mode decider 82 changes the operation modes of switch controllers $C_a$ and $C_b$ to be constant-current and fully-ON modes, respectively. In the opposite, if later on input voltage $V_{IN}$ ramps up and mode decider 82 finds current sense voltage VCS cannot decrease to approach current-setting voltage $V_{SET}$, switch controllers $C_b$ and $C_c$ are switched to operate in the fully-OFF and constant-current modes, respectively. As the currents passing path switches $S_a$, $S_b$ and $S_c$ are summed in current sensor 86 and current sense voltage VCS is controlled to approach current-setting voltage $V_{SET}$, management center 85 makes the summation of all the currents approach the target value corresponding to current-setting voltage $V_{SET}$.

In FIG. 8, line waveform sensor 28 could be any one of the line waveform sensors in FIGS. 5A and 5B, or any alternative. Line waveform sensor 28 decreases current-setting voltage $V_{SET}$ to decrease the target value of the current passing through each path switch when input voltage $V_{IN}$ exceeds reference voltage $V_{IN-REF}$. Accordingly, LED lighting system 80 could shine with substantially the same average luminance intensity, independent from the variation of the AC voltage.

Figure 9:
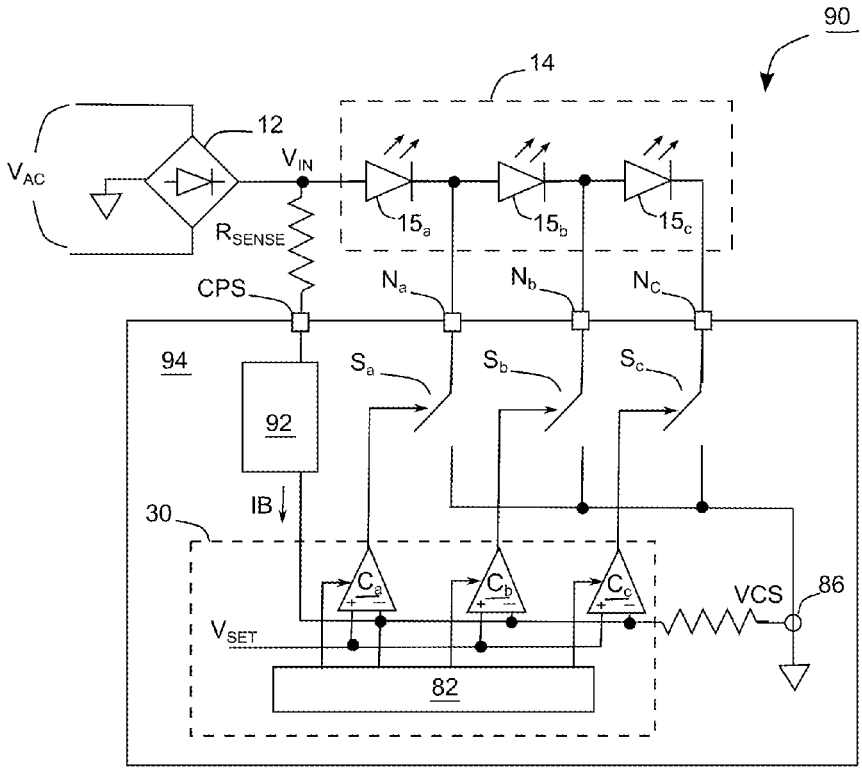

FIG. 9 shows another LED lighting system 90 according to embodiments of the invention. Line waveform sensor 92 in LED controller 94 provides boost current IB to slightly boost current sense voltage VCS and decrease the target value of the current passing through each path switch when input voltage $V_{IN}$ exceeds reference voltage $V_{IN-REF}$. The implementation and function of line waveform sensor 92 can be derived by persons skilled in the art based on the previous teachings and are not detailed herein.

Figure 10:
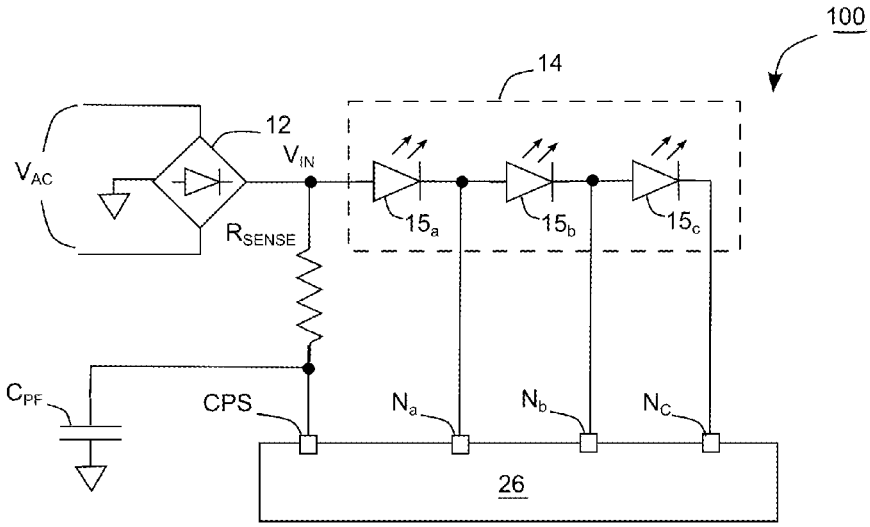
Figure 11:
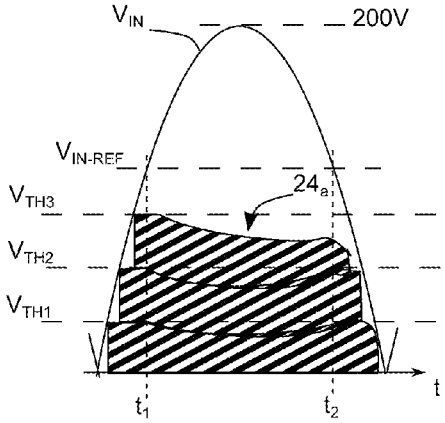
FIG. 11 demonstrates a luminance intensity result from the LED lighting system in FIG. 10 powered by a branch circuit of 200 ACV.

Even though a substantially-constant average luminance intensity can be achieved by the disclosed LED lighting systems, the decrease of the target value for the current passing through a path switch might deteriorate the power factor, which is higher if an input voltage is in phase with an input current. FIG. 4A shows that input voltage $V_{IN}$ during the time period between $t_1$ and $t_2$ are somehow out of phase with the current passing through a path switch because that input voltage $V_{IN}$ and the current vary just in opposite directions. It can be found by comparing FIG. 4A with FIG. 2A, that recess 24 in FIG. 4A implies FIG. 4A results in a power factor less than FIG. 2A. To lessen the impact to the power factor, a capacitor can be added into a LED lighting system according to embodiments of the invention, as exemplified in FIG. 10, where capacitor $C_{PF}$ is coupled between pin CPS and the ground. Even though in FIG. 10 capacitor $C_{PF}$ is an external component outside the integrated circuit with LED controller 26, embodiments of the invention might have a similar capacitor $C_{PF}$ coupled in the same way of FIG. 10 but embedded in the integrated circuit including LED controller 26. FIG. 11 demonstrates a luminance intensity result from LED lighting system 100 in FIG. 10 powered by a branch circuit of 200 ACV. Comparing with FIG. 4A, recess $\mathbf{24}_a$ in FIG. 11, because of the occurrence of capacitor $C_{PF}$, is slightly shifted to the right and has its right end lowered. The power fact achieved by FIG. 11 can be proved to be higher than that achieved by FIG. 4A.

Figure 12:
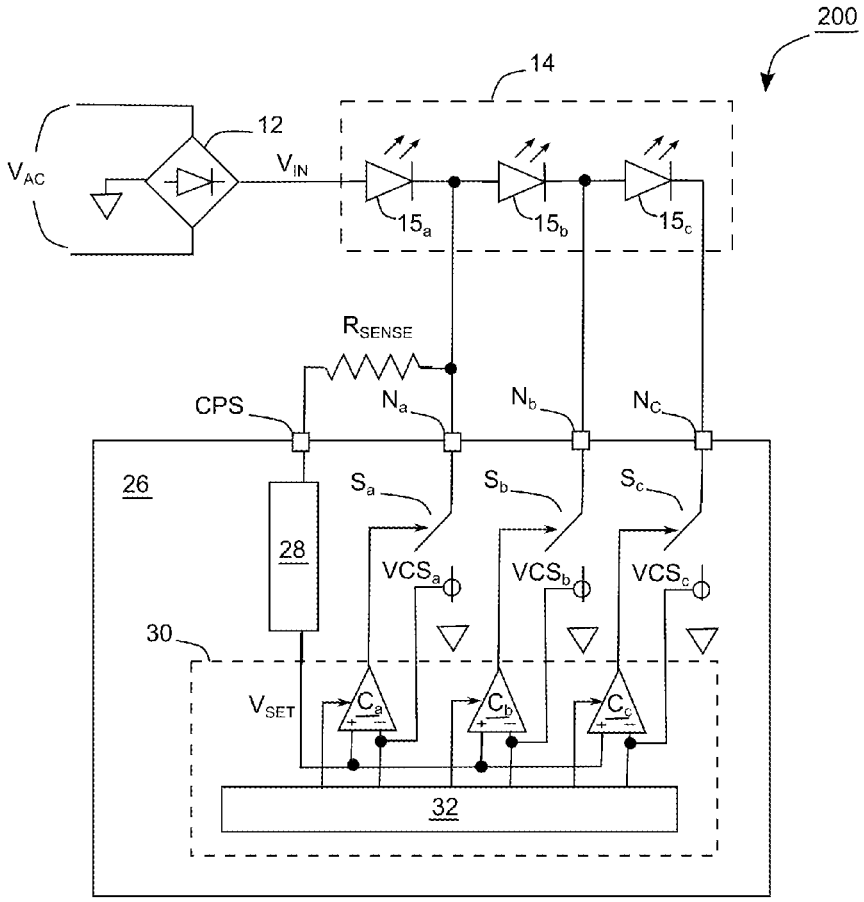
FIG. 12 shows another LED lighting system according to embodiments of the invention.

The foregoing embodiments of the invention have resistor $R_{SENSE}$ coupled between pin CPS and bridge rectifier 12 to sense the waveform of input voltage $V_{IN}$. The invention is not limited thereto, however. Pin CPS could be coupled to any connection nodes in driven LED string 14 of FIG. 3, for example, to sense the waveform of input voltage $V_{IN}$. FIG. 12 shows an exemplary LED lighting system 200, which is the same with the LED lighting system of FIG. 3 but has resistor $R_{SENSE}$ coupled between pin $N_a$ and pin CPS. LED controller 26 in FIG. 12 senses input voltage $V_{IN}$, indirectly via resistor $R_{SENSE}$ and LEDs $\mathbf{15}_a$. In other embodiments, resistor $R_{SENSE}$ could be coupled from pin CONSTANT-POWER SENSE to pin $N_b$ or pin $N_C$, instead.

Line waveform sensors according to embodiments of the invention are not limited to sense the sense current $I_{INS}$ flowing through resistor $R_{SENSE}$ into pin CPS, to determine the waveform of input voltage $V_{IN}$. In some embodiments, it is the voltage at pin CPS that a line waveform sensor senses to determine the target value of the current flowing in a LED string.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A light emitting diode (LED) controller, suitable for controlling a string of LEDs, wherein the LEDs are divided into LED groups electrically connected in series between a power source and a ground, the LED controller comprising:

path switches, each for coupling a corresponding LED group to the ground;

a management center for controlling the path switches, wherein when turning off an upstream path switch, the management center controls a downstream path switch for a downstream LED group to make the driving current passing the upstream LED group substantially approach a target value;

a constant-power sense pin;

a line waveform sensor coupled to the power source through the constant-power sense pin, for detecting a sense current flowing into the constant-power sense pin so as to sense the waveform of an input voltage of the power source and determine the target value according to waveform of the input voltage of the power source; and a reference voltage source for providing a reference voltage;

wherein the LED controller is coupled to the power source through a sense resistor, the sense current flows though the sense resistor, and the line waveform sensor is configured to decrease the target value when the input voltage is greater than the reference voltage.

2. The LED controller of claim 1, wherein the management center senses the current through each path switch to control the path switches.

3. The LED controller of claim 1, wherein the management center controls the path switches to make the summation of all the currents through the path switches approach the target value.

4. The LED controller of claim 1, wherein a path switch is adjusted when an upstream path switch is fully OFF and a downstream path switch is fully ON.

5. The LED controller of claim 1, wherein the LED controller is in an integrated circuit.

6. The LED controller of claim 1, wherein the LED controller is in an integrated circuit with a constant-power sense pin through which the line waveform sensor is direct or indirectly coupled to the power source, and the line waveform sensor detects the sense voltage at the constant-power sense pin to determine the target value.

7. A light emitting diode (LED) lighting system, comprising:

a string of LEDs, divided into LED groups electrically connected in series between a power source and a ground; and an LED controller, comprising:

path switches, each for coupling a corresponding LED group to the ground;

a management center for controlling the path switches, wherein a downstream path switch for a downstream LED group is controlled to make the driving current passing an upstream LED group substantially approach a target value;

a reference voltage source for providing a reference voltage;

a line waveform sensor coupled to the power source, for sensing the waveform of an input voltage of the power source according to a sense current, wherein the line waveform sensor is configured to decrease the target value when the input voltage is greater than the reference voltage; and a constant-power sense pin coupled to the line waveform sensor; and a sense resistor;

wherein the line waveform sensor is coupled to the power source through the constant-power sense pin and the sense resistor, and the sense current flows to the constant-power sense pin through the sense resistor.

8. The LED lighting system of claim 7, wherein the management center senses the current through each path switch to control the path switches.

9. The LED lighting system of claim 7, wherein the management center controls the path switches to make the summation of all the currents through the path switches approach the target value.

10. The LED lighting system of claim 7, wherein the LED controller further comprises:

a current sensor coupled between one of the path switches and the ground, to provide a current sense voltage substantially representing the current through at least one of the LED groups;

wherein the current sense voltage is adjusted according to the sense current.

11. The LED lighting system of claim 7, wherein the sense resistor is coupled between the constant-power sense pin and a node, and at least one of the LED groups is coupled between the node and the power source.

12. The LED lighting system of claim 7, further comprising:

a capacitor coupled between the constant-power sense pin and the ground.

13. A light emitting diode (LED) control method suitable for controlling a string of LEDs divided into LED groups electrically connected in series between a power source and a ground, the LED control method comprising:

providing path switches capable of separately coupling the LED groups to the ground;

gradually decreasing the current passing through an upstream path switch when the current through a downstream path switch gradually increases, such that the driving current passing an upstream LED group substantially approaches a target value;

sensing the waveform of an input voltage of the power source according to a sense current through a sense resistor coupled to the power source; and decreasing the target value by adjusting the target value according to the sense current when the input voltage is greater than a reference voltage provided by a reference voltage source.

14. The LED control method of claim 13, comprising:

providing a switch controller for controlling each path switch, wherein the switch controller has two input terminals inputted with current sense voltage and current setting voltage; and adjusting either the current sense voltage or the current setting voltage according to the input voltage to adjust the target value.

15. The LED control method of claim 13, comprising:

coupling a capacitor between the sense resistor and the ground;

wherein the sense resistor is coupled between the power source and a line waveform sensor controlling the target value.

* * * * *